US006983704B1

(12) United States Patent
Ness

(10) Patent No.: US 6,983,704 B1
(45) Date of Patent: Jan. 10, 2006

(54) OFFSHORE CARGO RACK FOR USE IN TRANSFERRING PALLETIZED LOADS BETWEEN A MARINE VESSEL AND AN OFFSHORE PLATFORM

(76) Inventor: Danny Ness, P.O. Box 9098, Metairie, LA (US) 70055

( * ) Notice: Subject to any disclaimer, the term of this patent is extended or adjusted under 35 U.S.C. 154(b) by 306 days.

(21) Appl. No.: 10/356,706

(22) Filed: Jan. 31, 2003

(51) Int. Cl.
*B65D 19/44* (2006.01)

(52) U.S. Cl. ..... 108/55.3

(58) Field of Classification Search ..... 108/55.3, 108/55.1, 55.5, 51.11, 57.2; 206/600, 386, 206/595; 211/59.4
See application file for complete search history.

(56) References Cited

U.S. PATENT DOCUMENTS

| | | | | |
|---|---|---|---|---|
| 2,579,655 | A * | 12/1951 | Donald | 108/55.1 |
| 2,683,010 | A | 7/1954 | Hamerslag, Jr. | |
| 3,776,435 | A * | 12/1973 | Smith | 108/55.1 |
| 3,916,803 | A | 11/1975 | Garcia | |
| 4,165,806 | A | 8/1979 | Cayton | |
| 4,403,556 | A * | 9/1983 | Van Gompel | 108/55.3 |
| 4,828,311 | A | 5/1989 | Hayashi | |
| 5,078,415 | A * | 1/1992 | Goral | 108/55.1 |
| 5,156,233 | A | 10/1992 | Olsen et al. | |
| 5,292,012 | A | 3/1994 | Davis et al. | |
| 5,507,237 | A | 4/1996 | Barrow et al. | |
| 5,906,165 | A * | 5/1999 | McCorkle et al. | 108/55.1 |
| 6,058,852 | A * | 5/2000 | Estvanko | 108/55.3 |
| 6,357,365 | B1 * | 3/2002 | Higgins et al. | 108/55.1 |
| 6,371,299 | B1 | 4/2002 | Essary | |
| 6,422,405 | B1 * | 7/2002 | Haenszel | 108/55.1 |
| 6,668,735 | B2 * | 12/2003 | Cassina | 108/55.1 |
| 6,725,783 | B2 * | 4/2004 | Sekino | 108/55.3 |

FOREIGN PATENT DOCUMENTS

GB 2004525 A * 4/1979

* cited by examiner

*Primary Examiner*—José V. Chen
(74) *Attorney, Agent, or Firm*—Garvey, Smith, Nehrbass & Doody, LLC; Charles C. Garvey, Jr.

(57) ABSTRACT

A cargo rack for transferring loads between a marine vessel and an offshore marine platform (for example, oil and gas well drilling or production platform) provides a frame having a front, a rear, and upper and lower end portions. The lower end of the frame has a perimeter beam base, a raised floor and a pair of open-ended parallel fork tine tubes or sockets that communicate with the perimeter beam at the front and rear of the frame, preferably being structurally connected (e.g., welded) thereto. Openings in the perimeter beam base align with the forklift tine tubes or sockets. The frame includes a plurality of fixed side walls extending upwardly from the perimeter beam that include at least left and right side walls. A plurality of gates are movably mounted on the frame including a gate at least at the front and at least at the rear of the frame, each gate being movable between open and closed positions, the gates enabling a forklift to place loads on the floor by accessing either the front of the frame or the rear of the frame. Each gate can be pivotally attached to a fixed side wall. The frame has vertically extending positioning beams or lugs that segment the raised floor into a plurality of load-holding positions. Each load holding position has a plurality of positioning beams or lugs that laterally hold a load module (e.g., palletized load) in position once a load is placed on the raised floor.

29 Claims, 5 Drawing Sheets

OFFSHORE CARGO RACK FOR USE IN TRANSFERRING PALLETIZED LOADS BETWEEN A MARINE VESSEL AND AN OFFSHORE PLATFORM

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to cargo racks for transferring goods between marine vessels and offshore platforms such as oil and gas well drilling and production platforms. More particularly, the present invention relates to an improved cargo rack that enables a user to load the rack with multiple palletized loads (or other loads) and to then transport the entire rack using a lifting device such as a crane or a forklift from the marine vessel to the platform. Additionally, the entire rack can be moved on land or on the platform with a crane or forklift.

2. General Background

In the exploration of oil and gas in a marine environment, fixed, semi submersible, jack up, and other offshore marine platforms are used during drilling operations. Fixed platforms are typically used for production of oil and gas from wells after they have been drilled. Drilling and production require that an enormous amount of supplies be transported from land based storage facilities. Supplies are typically transferred to offshore platforms using very large marine vessels called work boats. These work boats can be in excess of one hundred feet in length and have expansive deck areas for carrying cargo that is destined for an offshore platform. Supplies are typically transferred from a land based dock area to the marine vessel using a lifting device such as a crane or a mobile lifting and transport device such as a forklift.

Once a work boat arrives at a selected offshore platform, supplies or products are typically transferred from the deck of the work boat to the platform using a lifting device such as a crane.

Once on the deck of a drilling platform or production platform, space is at a premium. The storage of supplies on an offshore oil well drilling or production platform is a huge problem.

Many cargo transport and lifting devices have been patented. The table below lists some patents that relate generally to pallets, palletized racks, and other cargo racks.

TABLE 1

| PATENT NO. | TITLE | ISSUE DATE |
|---|---|---|
| 2,683,010 | "Pallet and Spacer" | Jul. 6, 1954 |
| 3,916,803 | "Loading Platform" | Nov. 4, 1975 |

TABLE 1-continued

| PATENT NO. | TITLE | ISSUE DATE |
|---|---|---|
| 4,165,806 | "Palletizing System for Produce Cartons and the Like" | Aug. 28, 1979 |
| 4,828,311 | "Metal Form Pallet" | May 9, 1989 |
| 5,156,233 | "Safety Anchor for Use with Slotted Beams" | Oct. 20, 1992 |
| 5,292,012 | "Tank Handling and Protection Structure" | Mar. 8, 1994 |
| 5,507,237 | "Lifting Apparatus for Use with Bulk Bags" | Apr. 16, 1996 |
| 6,357,365 | "Intermediate Bulk Container Lifting Rack" | Mar. 19, 2002 |
| 6,371,299 | "Crate Assembly and Improved Method" | Apr. 16, 2002 |

BRIEF SUMMARY OF THE INVENTION

The present invention-provides an improved cargo rack apparatus that includes a frame having a front, a rear, and upper and lower end portions.

The lower end portion of the frame provides a structural perimeter beam that can preferably a plurality of beams that are welded end to end to form a generally square or rectangular base.

A raised floor is attached to the perimeter beam or beams. A pair of open-ended parallel forklift tine tubes or sockets are provided that communicate with the perimeter beam (or beams) at both the front and the rear of the frame.

Openings in the perimeter beam align with these forklift tine sockets or tubes.

The frame preferably includes a plurality of side walls that extend upwardly from the perimeter beam including at least left and right side walls and front and rear gated side walls. A plurality of gates are mounted to the frame including a gate at least in the front and at the rear of the frame. Preferably a pair of gates can be provided both at the front and at the rear of the frame.

Each gate is movable between open and closed positions. The gates enable a forklift to place loads on the raised floor by accessing either the front or the rear of the frame.

The frame provides positioning beams that segment the raised floor into a plurality of load holding positions, each having positioning beams that extend vertically. These positioning beams laterally hold a load in position once that load is placed on the raised floor. For example, two or four palletized loads can be placed on the floor wherein the positioning beams are dimensioned to fit the corners of each of the pallets.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
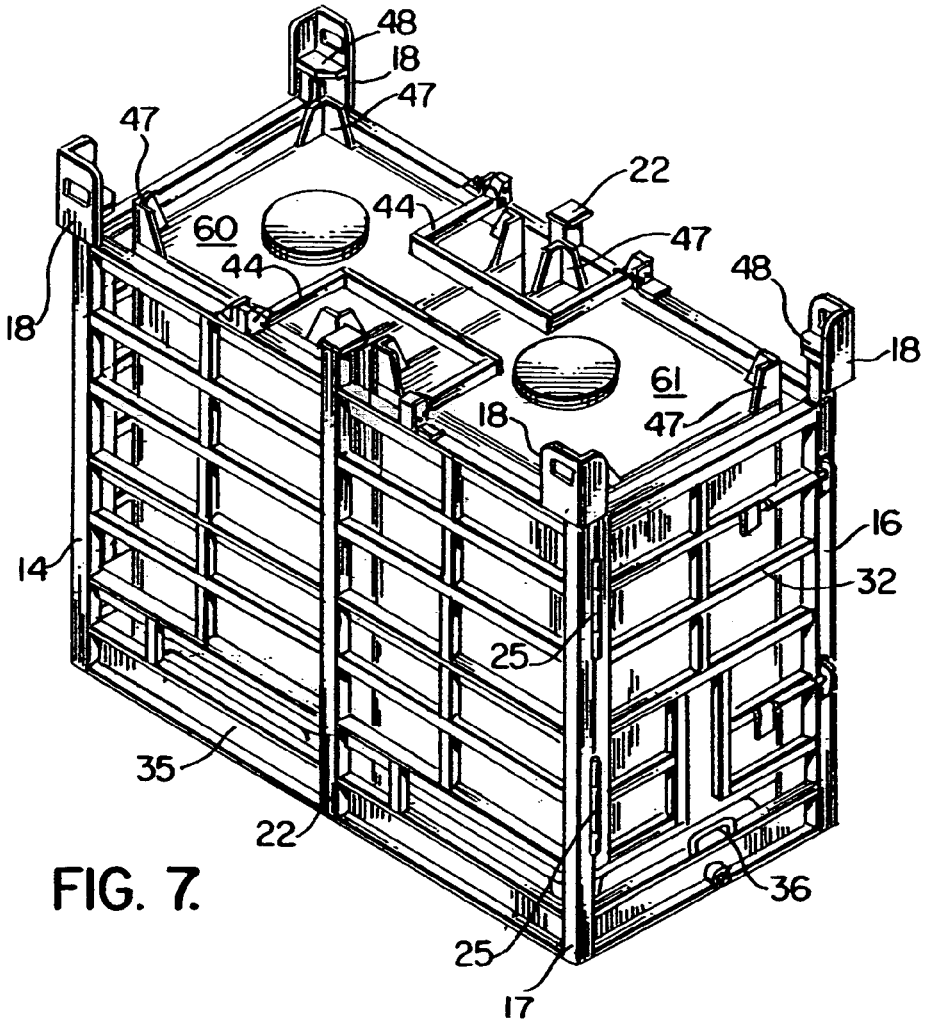
FIG. 7 is a perspective view of a second embodiment of the apparatus of the present invention.

FIGS. 1–6 show the preferred embodiment of the apparatus of the present invention designated generally by the numeral 10. An alternate embodiment 10A is shown in FIG. 7. The preferred embodiment 10 is configured to hold four loads 60, 61, 62, 63. The alternate embodiment 10A is configured to hold two loads 60, 61. The loads can be palletized loads such as, for example, pallets attached with sacks of drilling mud.

Cargo rack 10 provides a frame 11 having an upper end portion 12 and a lower end portion 13. The frame 11 includes four corner columns 14, 15, 16, 17. A lifting eye fitting 18 is fitted (for example, welded) to the top of each corner column 14–17 as shown on the drawings. For lifting rack 10 or 10A with a crane, rigging can be attached to each lifting eye fitting 18. Rigging can be for example slings 20 and shackles 21 as shown. Rigging can include spreader bars. Such rigging 19 enables the entire cargo rack 10 and its cargo to be lifted using the rigging 19 and a suitable lifting device such as a crane (and optionally spreader bar(s)) not shown.

Frame 11 has intermediate columns 22 that are positioned in between each of the corner columns 14 and 15, 15 and 16, 16 and 17, and 17 and 14.

Horizontal beams 23 span between the various columns 14–17 and 22. Additionally, vertical beams 24 can be provided for reinforcing the side walls of the frame 11. The side walls are defined by the combination of a perimeter beam 35, two corner columns 14–17, an intermediate column 22, and horizontal beams 23.

A pair of gates 32, 33 are provided both at the front and at the rear of frame 11 as shown. Front gates 32 include preferably a pair of gates 32. The rear gates 33 include preferably a pair of rear gates as well. These gates 32, 33 enable a forklift to load cargo to raised floor 27 of frame 11 from either the front of the frame 11 or from the back of the frame 11. The gates 32, 33 enable the raised floor 27 to be larger than a typically sized pallet and longer between the front and rear of the frame than the length of the tines of a forklift that might be in use on an offshore marine platform, dock or marine vessel.

The frame 11 provides a bottom surface 28 that is spaced below the raised floor 27, and in the same plane as the bottom of perimeter beams (or beam) 35.

A pair of spaced apart and generally parallel sockets or tubes 29, 30 are provided that enable a forklift to engage the socket or tubes 29, 30 and lift the entire frame 11. The sockets or tubes 29, 30 preferably extend from the front of frame 11 at perimeter beam 35 to the rear of the frame 11, also engaging a perimeter beam 35. Each tube or socket is preferably a structural steel member welded to perimeter beams 35.

In order to retain a load that is placed on the raised floor 27 of frame 11, straps 50 or clamps 44 can be used. In the case of straps 50, strap anchors 36 are provided above perimeter beam 35 and at the periphery of the frame 11. Alternatively, clamps 44 can be used to pivot into a closed position (see hard lines in FIGS. 3, 4 and arrow 49 in FIGS. 6 and 6). A locking pin 46 can be used to lock the clamp 44 in the closed position shown in FIG. 4. The clamps 44 are preferably pivotally connected with pivotal connections 45 to frame 11 at its upper end portion 12.

A plurality of pedestals 37 are provided on raised floor 27. These pedestals 37 provide upper surfaces that are preferably level for maintaining a palletized load in a level orientation. The pedestals 37 thus extend above the raised floor 27. The raised floor 27 can be inclined or sloped toward floor drains 34 that flow into drain line 31. The apparatus 10 of the present invention thus helps prevent or minimize pollution in the event of spillage by channeling any waste material or other spillage to the floor drains 34 and drain line 31 for collection via hose, pump or the like.

A plurality of corner supports 38 have positioning beams 39 that can be angle shaped wide flanged shaped beams that are positioned vertically. Likewise, a center support 40 provides positioning beams 41. Intermediate supports 42 can be provided that have positioning beams 43.

Figure 1:
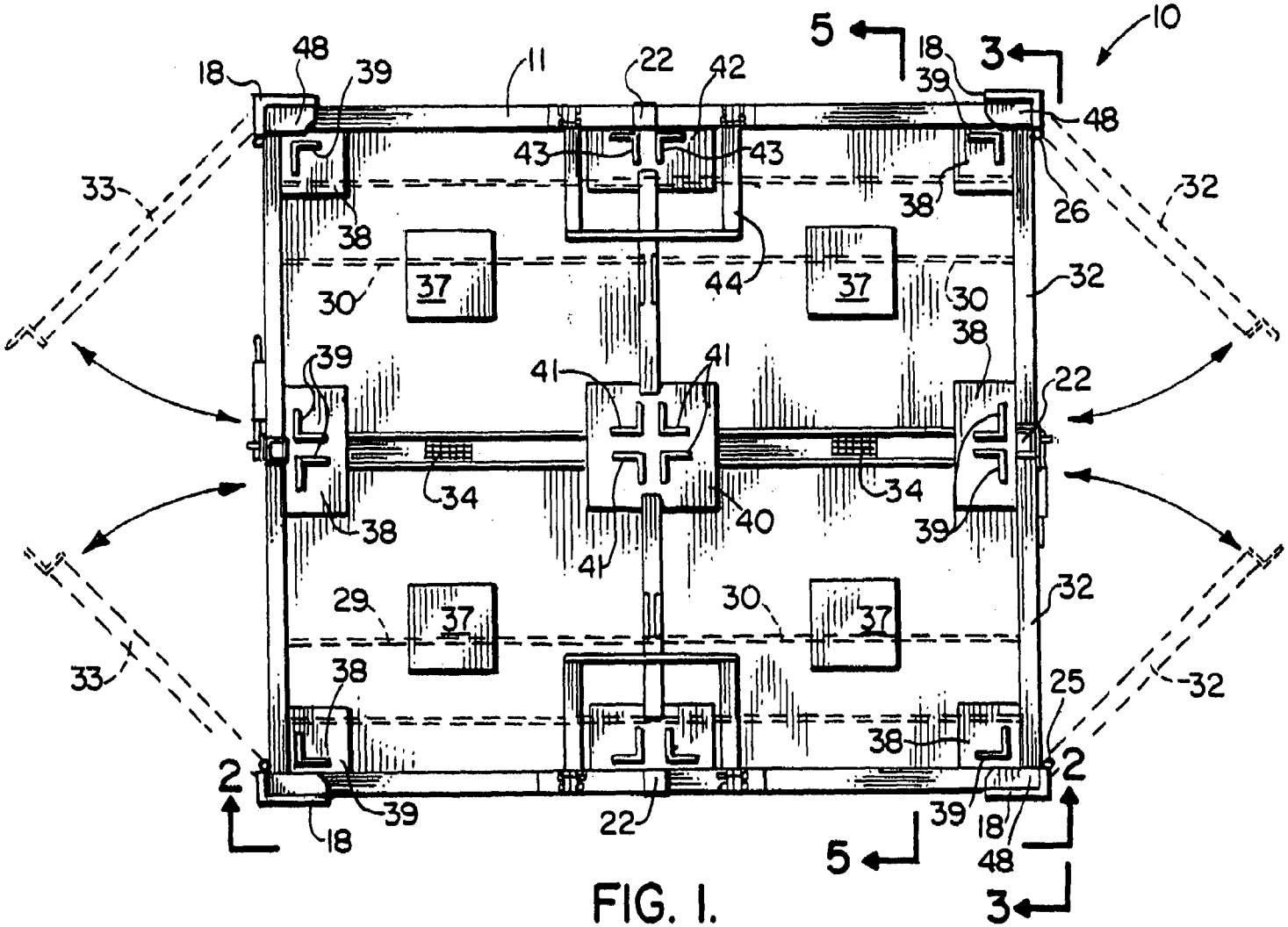
FIG. 1 is a top, plan view of the preferred embodiment of the apparatus of the present invention.
Figure 2:
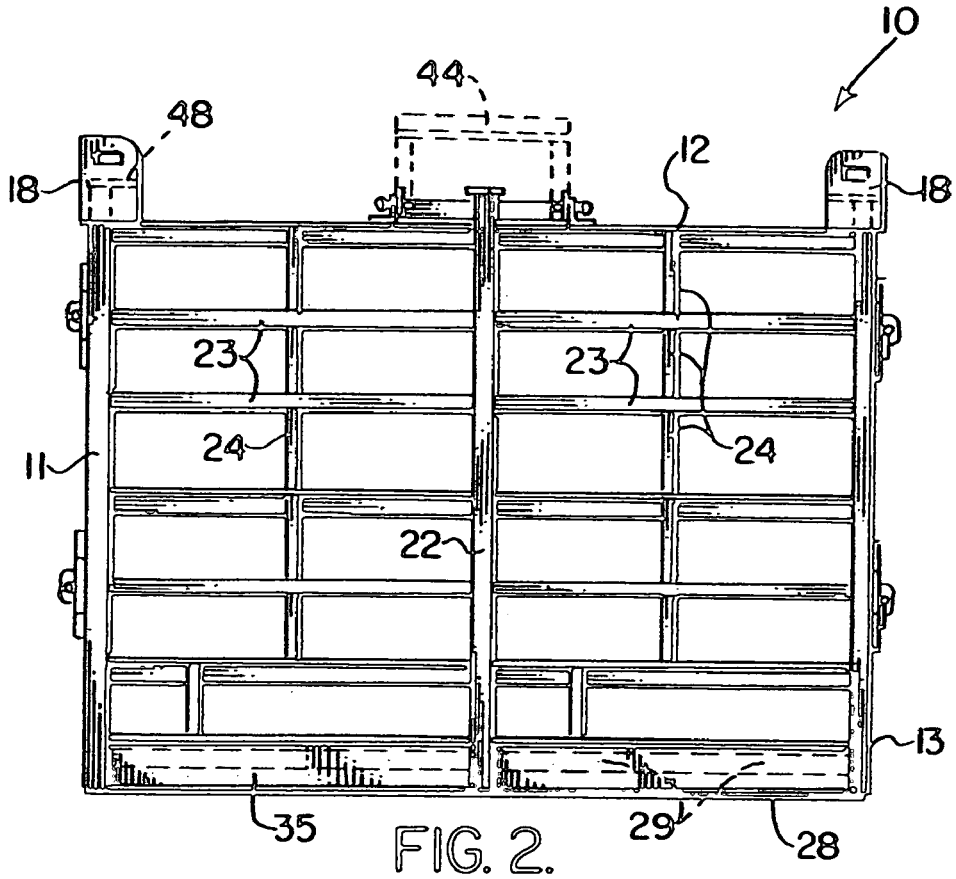
FIG. 2 is a side view of the preferred embodiment of the apparatus of the present invention taken along lines 2—2 of FIG. 1.
Figure 3:
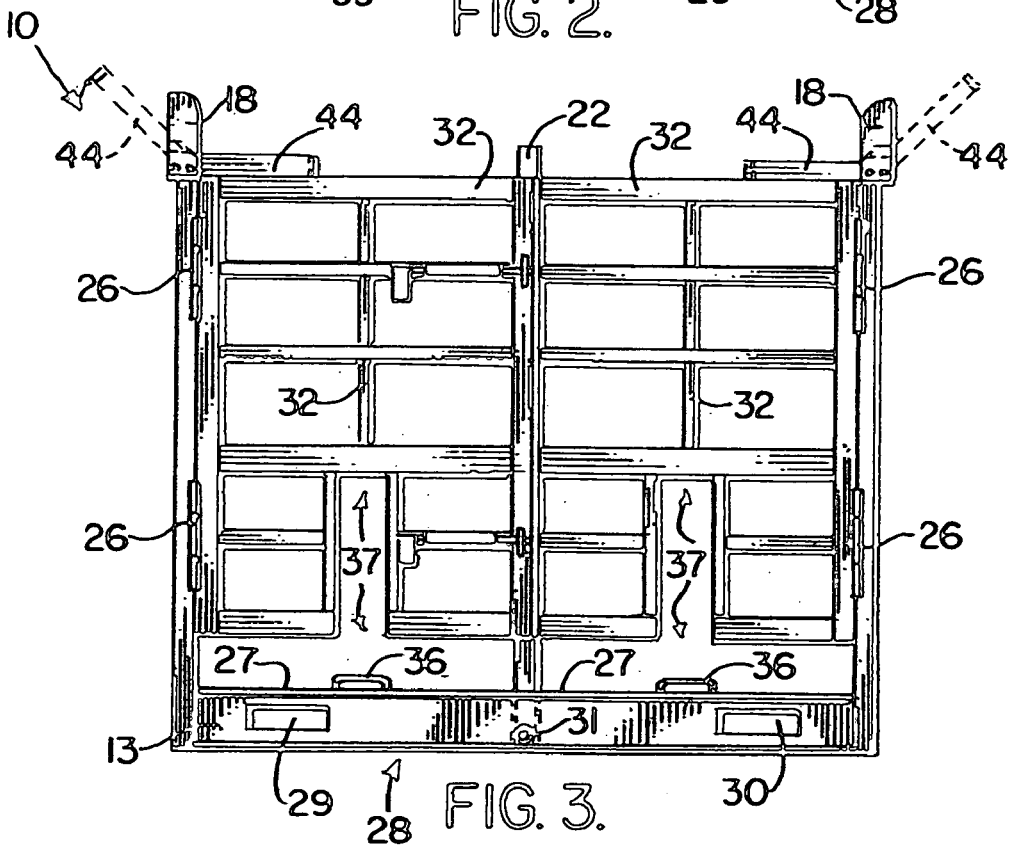
FIG. 3 is a front view of the preferred embodiment of the apparatus of the present invention taken along lines 3—3 of FIG. 1.
Figure 4:
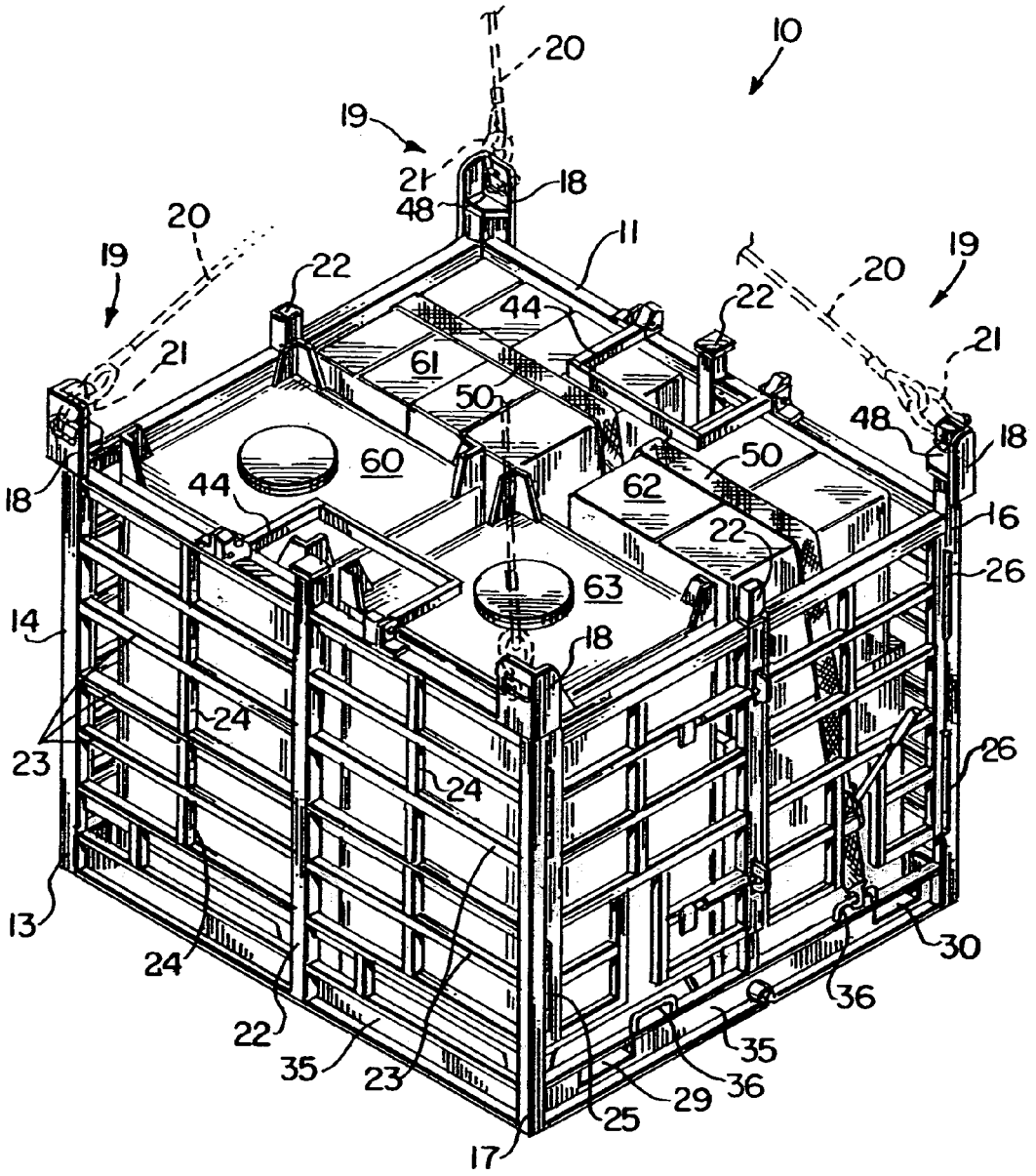
FIG. 4 is a perspective view of the preferred embodiment of the apparatus of the present invention.
Figure 5:
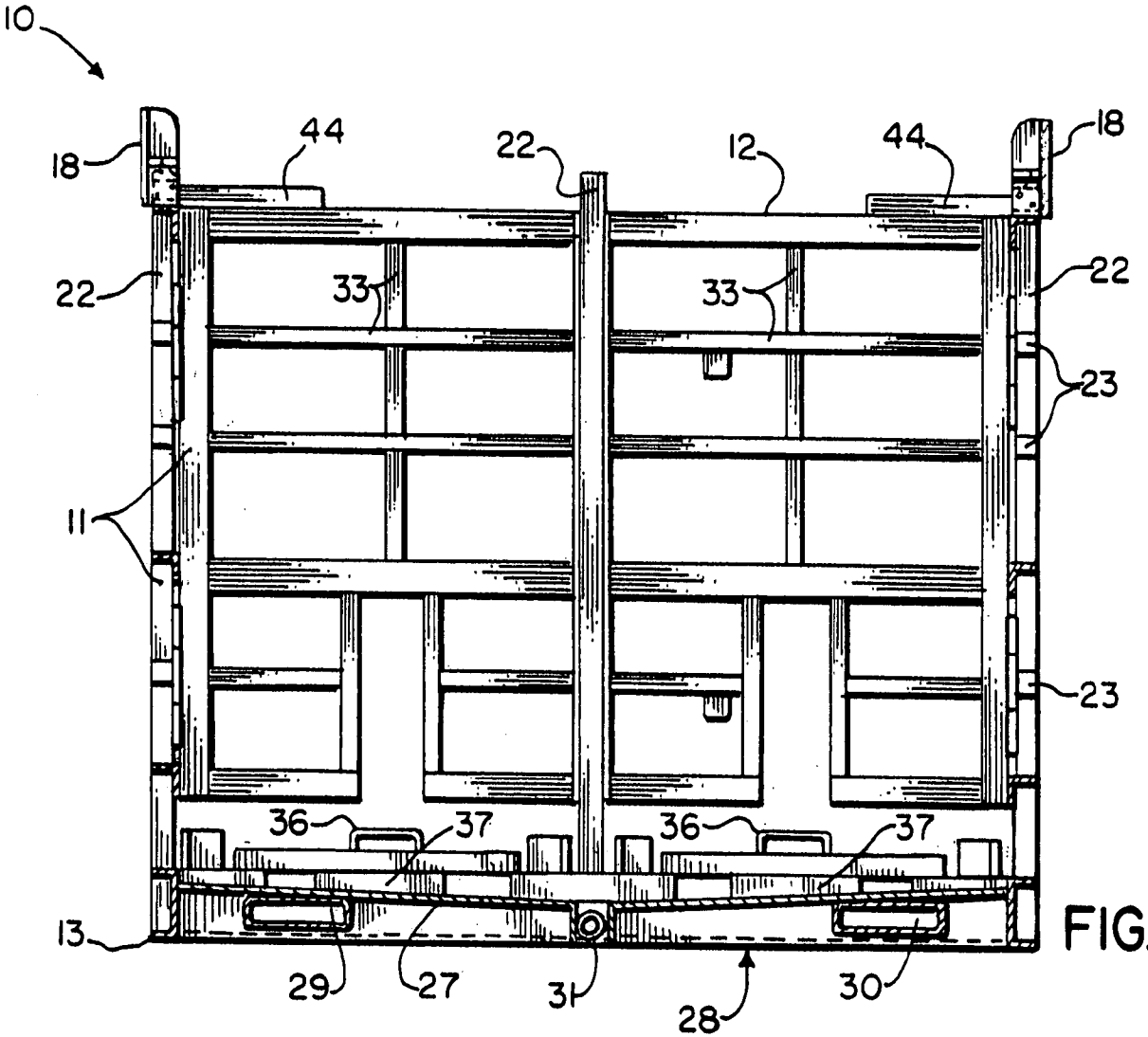
FIG. 5 is a sectional view taken along lines 5—5 of FIG. 1.
Figure 6:
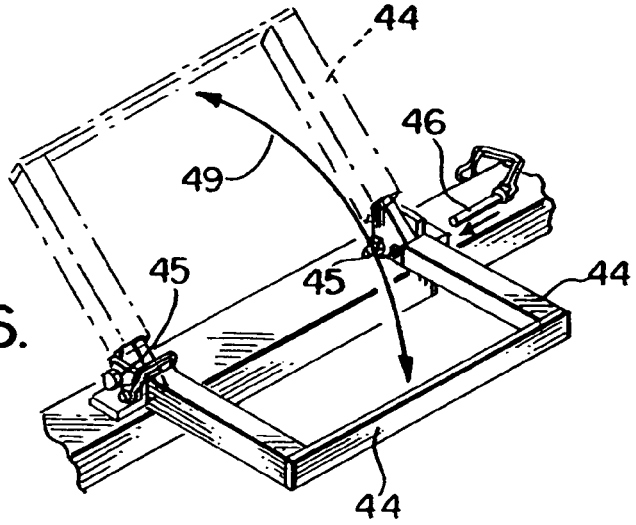
FIG. 6 is a fragmentary perspective view of the preferred embodiment of the apparatus of the present invention illustrating the clamp portions.

These positioning beams 39, 41, 43 help maintain a particular palletized load 60–63 in its proper position. In FIG. 4, some of the loads 60, 63 are held in position with clamp 44 while other of the loads 61, 62 are held in position with both clamp 44 and straps 50. Lugs 47 can be provided on the top of each load 60–63 so that loads 60–63 can be stacked one on top of another. Similarly, flanges 48 on each lifting eye fitting 18 enable one cargo rack 10 to be stacked upon another for saving space on the floor or work deck of an offshore marine platform or vessel.

The following is a list of suitable parts and materials for the various elements of the preferred embodiment of the present invention.

PARTS LIST

Part No. Description
10 cargo rack
10A cargo rack
11 frame
12 upper end
13 lower end
14 corner column
15 corner column
16 corner column
17 corner column
18 lifting eye fitting
19 rigging
20 sling
21 shackle
22 intermediate column
23 horizontal beam
24 vertical beam
25 hinge
26 hinge
27 raised floor
28 bottom surface
29 socket
30 socket
31 drain line
32 forward gate
33 rear gate

34 floor drain
35 perimeter beam
36 strap anchor
37 pedestal
38 corner support
39 positioning beam
40 center support
41 positioning beam
42 intermediate support
43 positioning beam
44 clamp
45 pivotal connection
46 locking pin
47 lug
48 flange
49 arrow
50 strap
60 load
61 load
62 load
63 load All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A cargo rack comprising:

a) a frame having a front, a rear, and upper and lower end portions;

b) a plurality of load modules that are supported with the frame during use;

c) the lower end portion having a perimeter beam base with a floor providing multiple load holding positions, each configured to hold a separate one of the load module;

d) the frame including a plurality of side walls that attach to and extend upwardly from the perimeter beam base and including at least left and right side walls, the frame having four corners with a corner column at each corner;

e) intermediate columns at the front and rear portions of the frame that are each positioned in between two corner columns;

f) a plurality of gates that are movably mounted to the frame, including a pair of gates at the front and a pair of gates at the rear of the frame, each gate being movably between open and closed positions, each gate spanning in a horizontal direction from a corner column to an intermediate column; and g) the frame having positioning beams that segment the raised floor into a plurality of load holding positions having multiple positioning beams that laterally hold a load module in position once a load module is placed in a selected position of the raised floor.

2. The cargo rack of claim 1 wherein there are four load holding positions.

3. The cargo rack of claim 1 wherein there are a pair of gates at the front of the frame.

4. The cargo rack of claim 1 wherein there are a pair of gates at the rear of the frame.

5. The cargo rack of claim 1 wherein at least a part of the raised floor is inclined.

6. The cargo rack of claim 5 wherein the raised floor attaches to an upper end portion of the perimeter beam.

7. The cargo rack of claim 5 wherein there is a drain opening in the raised floor.

8. The cargo rack of claim 1 wherein the raised floor attaches to an upper end portion of the perimeter beam.

9. The cargo rack of claim 1 further comprising clamps movably attached to the upper end of the frame between clamping and release positions for restraining vertical movement of a load that is placed on the raised floor.

10. The cargo rack of claim 1 further comprising raised pedestals that extend above the raised floor for providing a level surface to engage a load placed on a load holding position of the frame.

11. A cargo rack comprising:

a) a frame having a perimeter, a front, a rear, and upper and lower end portions;

b) the frame including a plurality of side walls extending upwardly from the frame perimeter and including at least left and right side walls, four corners that each provide a corner column and an intermediate column at the front and rear of the frame in between the corner columns;

c) a plurality of gates that are movably mounted to the frame, including a pair of gates at the front of the frame and a pair of gates at the rear of the frame, each gate being movable between open and closed positions, each gate extending between a corner column and an intermediate column; and d) the frame having positioning beams that segment the raised floor into a plurality of load holding positions, each having positioning beams that laterally hold a load module in position once a load is placed on the load platform.

12. The cargo rack of claim 11 wherein there are four load holding positions.

13. The cargo rack of claim 11 wherein there are a pair of gates at the front of the frame.

14. The cargo rack of claim 11 wherein there are a pair of gates at the rear of the frame.

15. The cargo rack of claim 11 wherein the load platform includes inclined portions.

16. The cargo rack of claim 15 wherein there is a drain in the load platform.

17. The cargo rack of claim 11 wherein the frame lower end portion includes a plurality of perimeter beams and the load platform attaches to the perimeter beams.

18. The cargo rack of claim 17 wherein the load platform attaches to the upper end portion of at least one of the perimeter beams.

19. The cargo rack of claim 11 further comprising clamps movably attached to the upper end of the frame between clamping and release positions for holding restraining vertical movement of a load that is placed on the load platform.

20. The cargo rack of claim 1 wherein there are four load holding positions.

21. A cargo rack comprising:

a) a frame having a front, a rear and upper and lower end portions;

b) a plurality of load modules that are supported with the frame during use;

c) the lower end portion having a plurality of connected perimeter beams including front, rear and side perimeter beams, and a floor;

d) the frame including a plurality of side walls extending upwardly from the perimeter beam and including at least left and right side walls, the frame having four corners and a corner column at each corner;

e) a plurality of gates that are movably mounted on the frame, including a pair of gates at the front of the frame and a pair of gates at the rear of the frame, each gate being movable between open and closed positions, the gates enabling the load modules to be loaded laterally to the floor by accessing either the front or the rear of the frame;

f) the frame having positioning beams that segment the floor into a plurality of load holding positions, each having positioning beams that laterally hold one of the load modules in position once a load module is placed on the floor and in a load holding position; and g) wherein the gates expose a majority of the width of the floor for loading a tank to a selected load holding position on the floor, either at the front or at the rear of the frame when the gates are opened.

22. The cargo rack of claim 21 wherein there are a pair of gates at the front of the frame.

23. The cargo rack of claim 21 wherein there are a pair of gates at the rear of the frame.

24. The cargo rack of claim 21 wherein the raised floor is inclined.

25. The cargo rack of claim 24 wherein the raised floor attaches to the upper end portion of at least some of the perimeter beams.

26. The cargo rack of claim 24 wherein there is a drain in the raised floor.

27. The cargo rack of claim 21 wherein the raised floor attaches to the upper end portion of at least some of the perimeter beam.

28. The cargo rack of claim 21 further comprising clamps movably attached to the upper end of the frame between clamping and release positions for holding restraining vertical movement of a load that is placed on the raised floor.

29. The cargo rack of claim 21 further comprising raised pedestals that extend above the raised floor for providing a level surface to engage a load placed on a load holding position of the frame.

* * * * *